US007103917B1

(12) United States Patent
Rodriguez-Jorge et al.

(10) Patent No.: US 7,103,917 B1
(45) Date of Patent: Sep. 12, 2006

(54) DECORATIVE NECKTIE ASSEMBLY AND METHOD

(76) Inventors: Alicia Rodriguez-Jorge, 888 Brickell Key, #1208, Miami, FL (US) 33131; Richard Cuello, 888 Brickell Key, #1208, Miami, FL (US) 33131

( * ) Notice: Subject to any disclaimer, the term of this patent is extended or adjusted under 35 U.S.C. 154(b) by 232 days.

(21) Appl. No.: 10/706,469

(22) Filed: Nov. 12, 2003

Related U.S. Application Data

(60) Provisional application No. 60/438,148, filed on Jan. 6, 2003, provisional application No. 60/424,820, filed on Nov. 12, 2002.

(51) Int. Cl.
*A41D 25/08* (2006.01)

(52) U.S. Cl. ..... 2/152.1

(58) Field of Classification Search ..... 2/137, 2/138, 144–145, 147–149, 152.1, 150, 153; 24/49.1, 57, 59, 62
See application file for complete search history.

(56) References Cited

U.S. PATENT DOCUMENTS

| | | | | |
|---|---|---|---|---|
| 2,528,356 | A | 10/1950 | Fruns | |
| 3,745,614 | A * | 7/1973 | Tsang | 2/148 |
| 3,964,105 | A * | 6/1976 | Gideon | 24/49.1 |
| 4,000,523 | A | 1/1977 | Woods | |
| 4,173,793 | A | 11/1979 | Yasui | |
| 4,184,231 | A | 1/1980 | Konnan | |
| 4,246,658 | A | 1/1981 | Liaw | |
| 4,748,692 | A | 6/1988 | Fukushima | |
| 5,010,593 | A | 4/1991 | Stevens, Jr. | |
| D317,275 | S | 6/1991 | Lopez | |
| 5,088,120 | A | 2/1992 | Yen | |
| 5,165,112 | A | 11/1992 | Dawes | |
| 5,216,757 | A | 6/1993 | Dorkin | |
| 5,979,021 | A | 11/1999 | Swift | |

* cited by examiner

*Primary Examiner*—Tejash Patel
(74) *Attorney, Agent, or Firm*—Malloy & Malloy, P.A.

(57) ABSTRACT

A necktie assembly is provided in conjunction with a method to facilitate disposition of a necktie on a wearer in a neat and decorative, new and fanciful, yet operative position. The necktie assembly includes a base member interconnected to a face member, the intersection of the members forming an opening or slot through which at least an overlying section of the necktie may pass through. The base member includes an attachment mechanism structured to removably secure the base member to an underlying section of a necktie, adjacent the neck of the wearer. The face member may include one or more adornment features structured to accentuate the appearance of the wearer of the necktie assembly. The method facilitates donning a necktie in a neat and decorative, new and fanciful, yet operative position without requiring the skills necessary to fully tie a decorative knot in the necktie.

4 Claims, 9 Drawing Sheets

DECORATIVE NECKTIE ASSEMBLY AND METHOD

CLAIM OF PRIORITY

The present application is based on and a claim of priority is made under 35 U.S.C. Section 119(e) to a provisional patent application currently abandoned in the U.S. Patent and Trademark Office and having Ser. No. 60/424,820 with a filing date of Nov. 12, 2002, and to another provisional patent application also currently abandoned in the U.S. Patent and Trademark Office having Ser. No. 60/438,148 and a filing date of Jan. 6, 2003, each of which is incorporated by reference herein in its entirety.

BACKGROUND OF THE INVENTION

1. Field of the Invention

The present invention is directed to an assembly structured to facilitate disposition of a necktie in a neat and decorative, new and fanciful, yet operative position on a wearer and may include adornment features to help accentuate the appearance of the wearer. The invention is also directed to a method of disposing a necktie in a neat and decorative, yet operative position on a wearer, utilizing the necktie assembly disclosed herein, which eliminates the need to fully tie a decorative knot in a traditional manner on a necktie.

2. Description of the Related Art

It is common practice in western cultures for men, and occasionally women, to wear a necktie to compliment most forms of dress including formal, business, and often times, business casual attire. Most neckties are made from a single swath of material, and thus comprise a uniform pattern or appearance over their entire length, and typically include at one end region a relatively narrow or tapered section versus at the other end region, a wider section which will overly the tapered section when the tie is disposed on a wearer in an operative position. In use, the necktie is positioned in an at least partially surrounding relation to the wearer's neck, and any one of a number of knots may be formed in the necktie adjacent the wearer's neck to maintain the necktie in an operative position on the wearer. In spite of the variety of available knots, the appearance of a tied necktie disposed in the operative position on the wearer has remained essentially unchanged in recent memory.

In addition, it is well known that many people have difficulty accomplishing even the simplest knot in a necktie, such as the common "windsor" knot. As such, a number of devices have been developed which are structured to attach to one or more sections of a necktie to simulate the appearance of a knot. Such devices are structured to be at least partially positionable over the overlying section of the necktie in an operative position adjacent the wearer's neck, and include an outer face comprising a generally triangular shape to simulate the appearance of one of the various knots commonly used to secure a necktie in an operative position. Any well known fastening means, such a clip, clasp, and/or pin, may be utilized to secure such a device to one or more sections of the necktie, such that the device is maintained in the operative position. Although these devices effectively simulate the overall shape and appearance of the knots commonly used to secure a necktie, a problem lies in the fact that neckties come in a multitude of styles, colors, and/or patterns, and as such, a multitude of these devices would be required to permit the wearer to at least partially match the device with a necktie. It should be apparent that properly matching the device simulating the knot to the pattern of necktie desired to be worn will be difficult at best, with the likely result being an awkward appearance due to a mismatched necktie and simulated knot, which is counter to the purpose of wearing the necktie in the first place.

Another device has been developed to permit the wearer of a necktie to simulate the appearance of a knot, without completely tying a knot in the necktie. This device comprises a figure eight type of configuration and is structured to be positioned over the overlying section of the necktie in an operative position adjacent the neck of the wearer. A narrow upper rim defines an upper boundary of a simulated knot, while a wide lower band defines a lower boundary of the same, thereby providing the appearance of a knot in the necktie. This device includes interconnecting flanges having a prong structured to be secured to the portion of the necktie which is at least partially tied in a knot, to retain the device in an operative position on the necktie adjacent the wearer's neck.

Other devices have been developed to compliment and/or accentuate the appearance of the necktie on the wearer. The most common among these devices are tie clasps, which serve to maintain the lower section or sections of the necktie in position about the midsection of the wearer. Tie clasps have been the mainstay accessory item for neckties, and the outer face of the tie clasp can be adorned with a decorative figure, emblem and/or initials. Tie clasps may also be formed of precious metal and may include one or more gemstones to further accentuate the wearer's appearance. A common problem with most tie clasps, however, is that the typical "clasp" attachment is not very secure, and when combined with their intended placement near the midsection of the wearer where the clasp is subject to displacement as the wearer moves about, this makes tie clasps quite susceptible to loss and/or theft. This problem is particularly troublesome when the tie clasp is made of precious metal and/or including gemstone(s). To overcome this defect, there are some tie clasps that are structured to be attached to the overlying section of the tie by a pin and fastener which, although providing a more secure means of attachment, results in damage to the tie due to repeated piercing by the pin.

Thus, there remains a need in the art for an assembly which facilitates the process of donning a necktie generally, as well as which results in a neat and decorative, yet operative position of the tie on a wearer, without requiring the skill necessary to tie a decorative knot in the necktie. In addition, it would be beneficial to provide an assembly which effects a new and fanciful appearance to a necktie disposed in an operative position on a wearer. It would also be advantageous if any such assembly were structured to work with any number of neckties, and further, to accentuate the appearance of the wearer. If any such assembly were developed, it would preferably be capable of being made of or otherwise to include one or more precious metals, gemstones and/or other decorative designs or features. It would further be beneficial if any such assembly were capable of being disposed on a necktie in a secure manner, such that the potential for loss or theft of the assembly is minimized and such that the necktie is not damaged. Also, it would be desirable for any such assembly to allow the external appearance to be quickly and easily varied to allow the assembly to accentuate neckties having a wide variety of styles, colors, and/or patterns. Further, it would be beneficial to provide a method for utilizing such an assembly to allow a wearer to don a necktie in a neat and decorative, new and fanciful, yet operative manner, which eliminates the need to fully tie a decorative knot in the necktie.

SUMMARY OF THE INVENTION

The present invention is intended to present a solution to these and other needs which remain in the art, and as such, is directed to a necktie assembly structured to facilitate disposition of a necktie in a neat and decorative, new and fanciful, yet operative position on a wearer. In particular, the necktie assembly of the present invention includes a base member which includes an attachment mechanism at least partially interconnected thereto. The attachment mechanism of the present invention is structured to engage at least a portion of a necktie, thereby providing means for removable yet secure attachment of the base member to at least a portion of the necktie.

The necktie assembly also includes a face member interconnected to the base member in an at least partially overlying relation. The interconnection of the base member and the face member at least partially defines an opening or a slot between the members which is structured to receive at least the overlying section of the necktie therethrough. The base member and/or the face member may be constructed of any one of a number of known materials including, but by no means limited to, plastic, ceramic, wood, metal and/or precious metal.

In at least one embodiment, the face member comprises an adornment feature structured to accentuate the appearance of the wearer of the necktie assembly of the present invention. In one embodiment, the adornment feature may include, by way of example only, a decorative motif such as an emblem, a symbol, the wearer's initials, etc. The decorative motif may be applied onto the face member by any one of a number of well known means such as, painting, etching, engraving, etc., but it is understood that other means of applying the decorative motif to the face member may be utilized which fall within the scope of the present invention.

The adornment feature may also include, either alone or in conjunction with the decorative motif, one or more gemstones, attached to the face member. It is within the scope of the present invention to utilize either genuine, synthetic, or simulated gemstones as the adornment feature. It is also within the scope of the invention to utilize other stones and/or types of materials to create the adornment feature.

The present invention further comprises a method to facilitate disposing a necktie in a neat and decorative, new and fanciful, yet operative position on a wearer, without fully tying a decorative knot in the necktie. In one embodiment, the method includes forming at least a partial knot in the necktie which is disposed in an at least partially surrounding relation to the wearer's neck, and tightening the partial knot into an at least partially operative position adjacent the wearer's neck. The method of the present invention may further comprise attaching a necktie assembly to an underlying section of the necktie below and adjacent the partial knot. In addition, the method comprises positioning an overlying section of the necktie into an overlying disposition relative to the partial knot, and looping a free end of the overlying section of the necktie through an opening or a slot in the necktie assembly. Further, the method provides for tightening the overlying section of the necktie into a neat and decorative, new and fanciful, yet operative position through the opening in the necktie assembly.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 1-A is a plan view of one alternate embodiment of the necktie assembly of the present invention.

FIG. 3-A is a plan view of the embodiment of FIG. 3 illustrating the attachment mechanism in an open orientation.

FIG. 5-A is a plan view of the embodiment of FIG. 5 illustrating the attachment mechanism in an open orientation.

Like reference numerals refer to like parts throughout the several views of the drawings.

DETAILED DESCRIPTION OF THE PREFERRED EMBODIMENT

The present invention is directed to a necktie assembly, generally shown as 10, which is structured to facilitate the donning of a necktie, but also, to dispose the necktie in a neat and decorative, new and fanciful, yet operative position on a wearer. The present invention further encompasses a method for utilizing such a necktie assembly 10 which permits a wearer to don a necktie in a neat and decorative, new and fanciful, yet operative manner and, also important, the method eliminates the need to fully tie a decorative knot in the necktie, a procedure which many people find difficult and frustrating.

Figure 1:
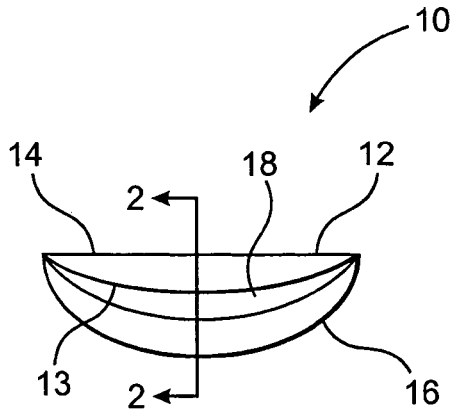
FIG. 1 is a plan view of one embodiment of the necktie assembly of the present invention.
Figure 1A:
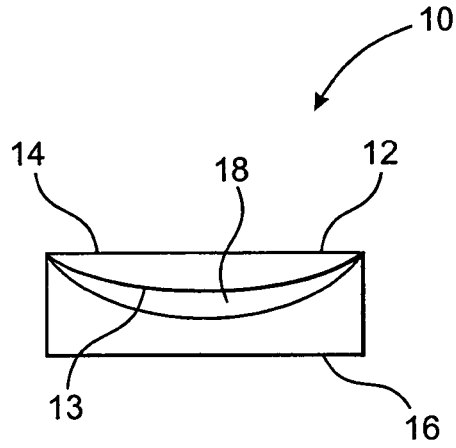
Figure 2:
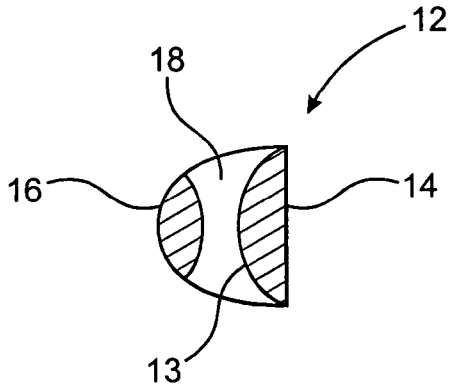
FIG. 2 is a cross section of the embodiment of the necktie assembly of FIG. 1 along lines 2—2 thereof.
Figure 13:
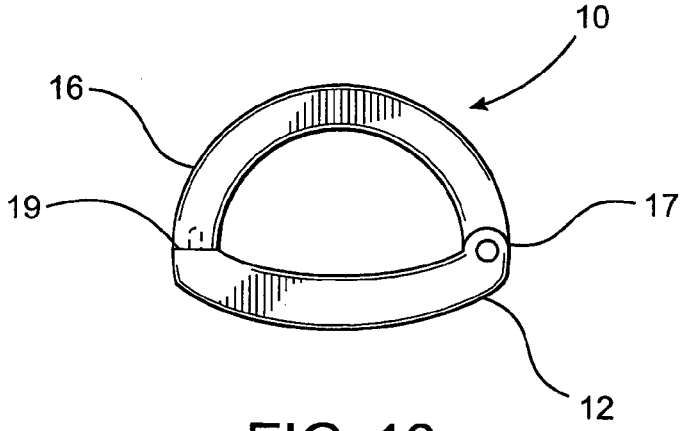
FIG. 13 is a plan view of one preferred embodiment of the necktie assembly of the present invention.
Figure 14:
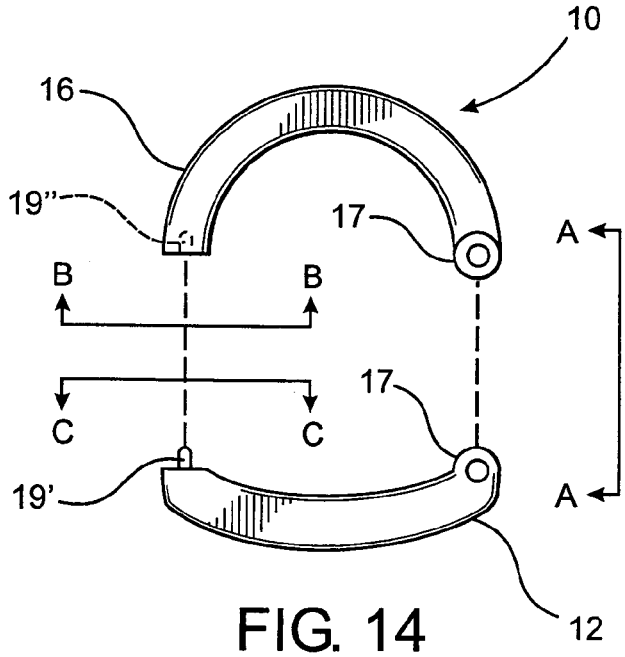
FIG. 14 is a partially exploded plan view of the embodiment of FIG. 13.
Figure 15:
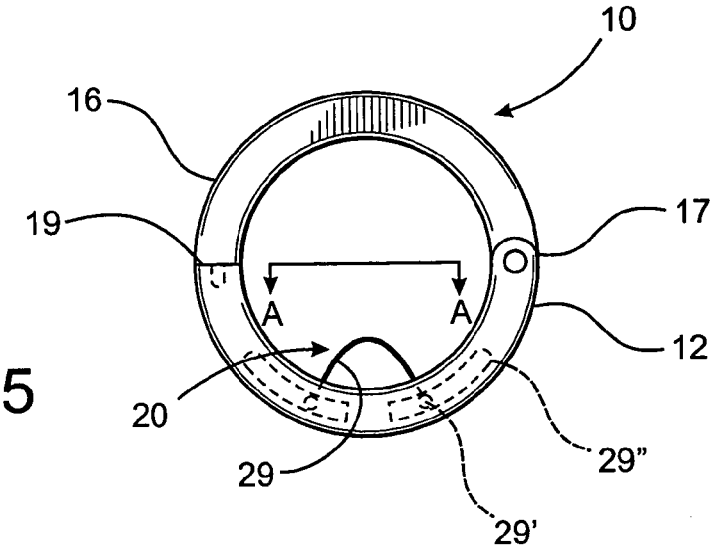
FIG. 15 is a plan view of one other preferred embodiment of the present invention illustrating a biasing element in an uncompressed configuration.
Figure 16:
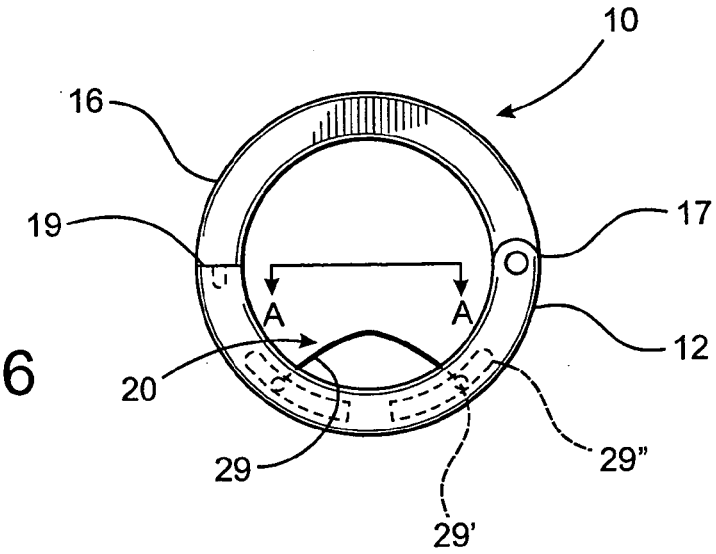
FIG. 16 is a plan view of the preferred embodiment of FIG. 15 illustrating a biasing element in a compressed configuration.
Figure 17:
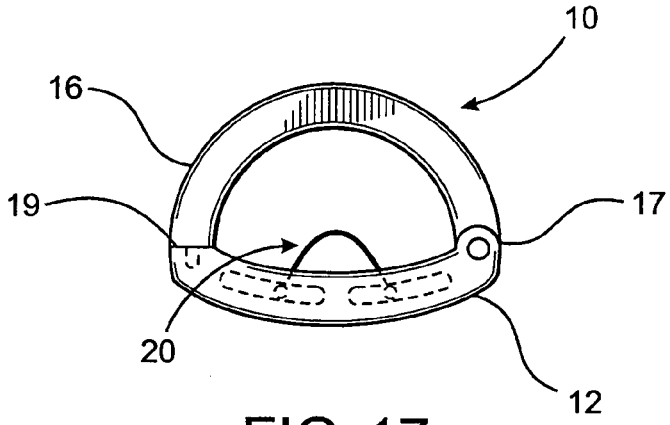
FIG. 17 is a plan view of another preferred embodiment of a necktie assembly of the present invention.

With initial reference to FIGS. 1 and 2, the necktie assembly 10 of the present invention comprises a base member 12 having a front or outer surface 13 and a rear or inner surface 14. In at least one embodiment, the outer surface 13 comprises a convex configuration, as illustrated in FIGS. 1 through 5, and 11, a feature which is discussed in greater detail below. In one preferred embodiment, however, the entire base member 12 may comprise either a substantially flat configuration, as illustrated in FIGS. 13, 14, and 17, or in another preferred embodiment, the base member 12 may comprise a concave configuration, as illustrated in FIGS. 15 and 16.

Figure 5:
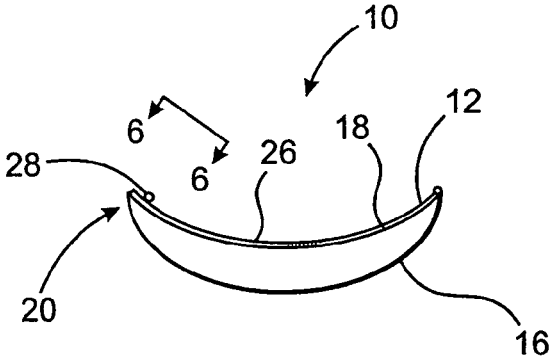
FIG. 5 is a plan view of an alternate embodiment of the necktie assembly of the present invention illustrating yet another alternate embodiment of an attachment mechanism in a closed orientation.
Figure 5A:
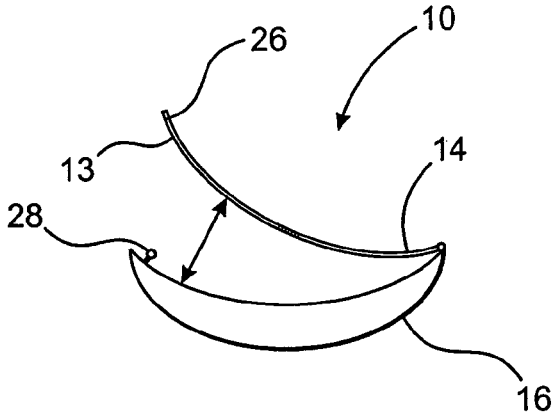

In addition, the necktie assembly 10 comprises a face member 16 interconnected with the base member 12 and disposed in an at least partially overlying relation thereto. The base member 12 and the face member 16 may comprise any one of a number of materials of construction including, by way of example only, plastic, ceramic, stone, wood, glass, metal, precious metal and/or metal alloy or other composite material. In at least one embodiment, the base member 12 and the face member 16 may be securely interconnected to one another, such as is illustrated in FIGS. 1, 1-A, 3, 3-A, and 4. In at least one other embodiment, the base member 12 and the face member 16 are movably interconnected to one another, such as is illustrated in the embodiment of FIGS. 5 and 5-A, and in the preferred embodiments illustrated in FIGS. 13 through 17.

Regardless of the specific type of interconnection between the base member 12 and the face member 16, they are structured to at least partially define an opening or slot 18 between one another (such as a channel, slot, notch, groove, or other opening), the opening 18 being further defined by one or more intersections between the base member 12 and the face member 16, as shown throughout the figures. The opening 18 is structured to receive at least a portion of the necktie therethrough, as will become more clear from the discussion herein, and which may, for example, be an overlying section of the necktie.

In at least one embodiment, illustrated primarily in FIGS. 1 through 5, and 11, the convex configuration of the outer surface 13 of the base member 12 acts to orient the portion of the necktie disposed through the opening 18, such as the overlying section of the necktie, in a convex configuration, which imparts a neat and decorative appearance to the necktie when disposed in an operative position with the necktie assembly 10.

With reference now to FIGS. 3 through 6, the necktie assembly 10 of the present invention may additionally comprise an attachment mechanism, generally as shown at 20. In at least one embodiment, the attachment mechanism 20 is at least partially interconnected to the rear or inner surface 14 of the base member 12, as illustrated in FIGS. 3 through 6. The attachment mechanism 20 is structured to engage a portion of the necktie, and in at least one embodiment, the attachment mechanism 20 is structured to removably secure the base member 12 to at least a portion of an underlying section of the necktie, such that the necktie assembly 10 is not free to slip down and off of the necktie.

Figure 3:
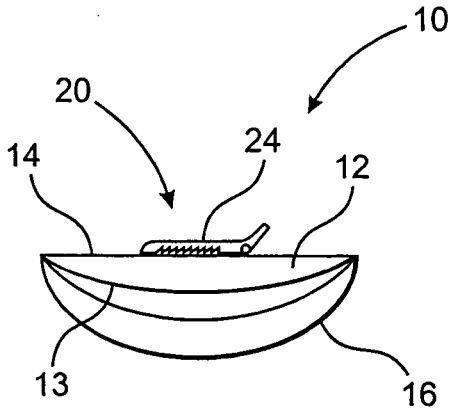
FIG. 3 is a plan view of the necktie assembly of FIG. 1 illustrating one embodiment of an attachment mechanism in a closed orientation.
Figure 3A:
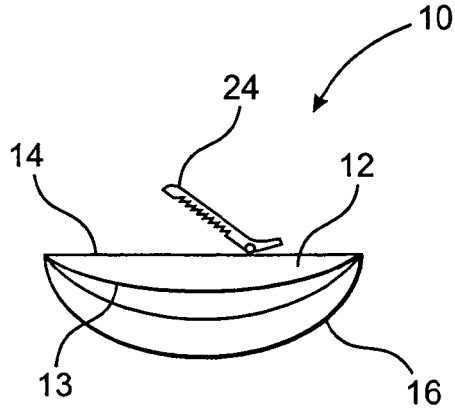

In one embodiment, the attachment mechanism 20 comprises a clip 24 secured to the inner surface 14 of the base member 12, as shown in FIGS. 3 and 3-A. The clip 24 is selectively disposable between a closed orientation which, as shown in FIG. 3, will permit the attachment mechanism 20 to securely attach to at least a portion of the underlying section of the necktie. In addition, the clip 24 may be disposed into an open orientation which, as shown in FIG. 3-A, facilitates positioning the attachment mechanism 20 around at least the portion of the underlying section of the necktie.

Figure 4:
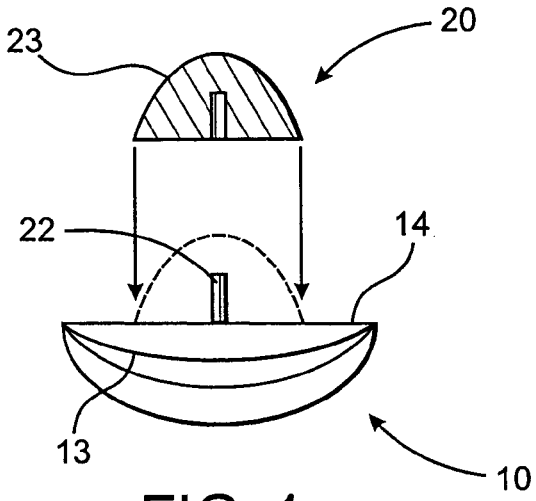
FIG. 4 is a plan view of the necktie assembly of FIG. 1 illustrating an alternate embodiment of an attachment mechanism.

An alternate embodiment of the necktie assembly 10 of the present invention is illustrated in FIG. 4. In particular, the attachment mechanism 20 of this illustrated embodiment comprises a post 22 secured to the inner surface 14 of the base member 12. Additionally, in this embodiment, the attachment mechanism 20 further comprises a fastener 23 which is structured to engage the post 22 in a securing relation, as depicted by the phantom lines in FIG. 4.

Figure 6:
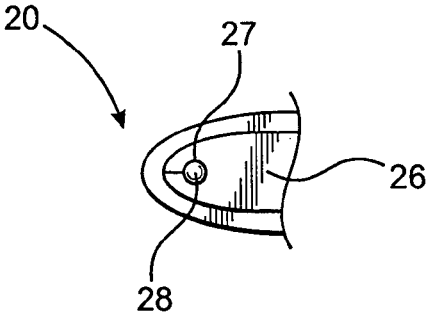
FIG. 6 is a partial rear elevation of the embodiment of FIG. 5 illustrating the attachment mechanism in a closed orientation.

FIGS. 5 and 5-A illustrate yet another embodiment of an attachment mechanism 20 of the necktie assembly 10 of the present invention. Specifically, the attachment mechanism 20 illustrated in FIGS. 5, 5-A and 6 comprises a clasp 26. The clasp 26 further comprises a male portion 28 which is structured to securely yet removably engage a female portion 27. As illustrated in FIG. 6, the female portion 27 of the clasp 26 may comprise an aperture through a portion of the base member 12, and the male portion 28 may comprise a pin or other protrusion extending outwardly from the under-side of the face member 16. It is also envisioned that the male portion 28 may extend outward from the base member 12 while the female portion 27 comprises an aperture in the face member 16.

Also, as shown in the embodiment of FIGS. 5 and 5-A, both the outer surface 13 and the inner surface 14 of the base member 12 may comprise a convex configuration wherein the opening 18 is structured to receive both the overlying and underlying sections of the necktie. Further, as illustrated in FIG. 5-A, the base member 12 and the face member 16 of the necktie assembly 10 may be movably interconnected to one another.

Figure 14A:
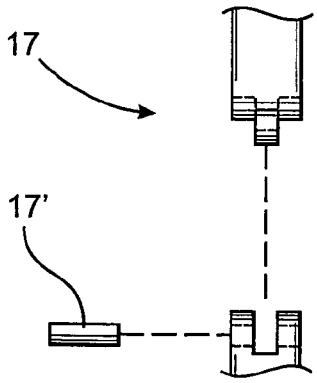
FIG. 14A is a partial side view of the necktie assembly of FIG. 14 taken along lines A—A thereof illustrating one embodiment of a hinge mechanism having a hinge pin.
Figure 14B:
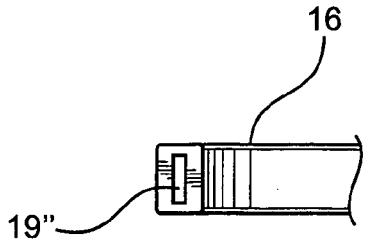
FIG. 14B is a partial rear elevation of the face member of the embodiment of FIG. 14 along lines B—B thereof illustrating one embodiment of a groove element disposed on the face member.
Figure 14C:
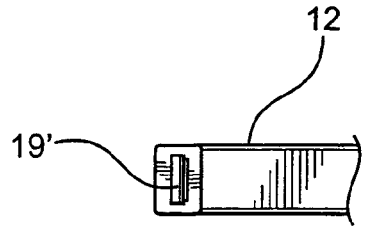
FIG. 14C is a partial front elevation of the base member of FIG. 14 along lines C—C thereof illustrating one embodiment of a tongue element disposed on the base member.
Figure 13A:
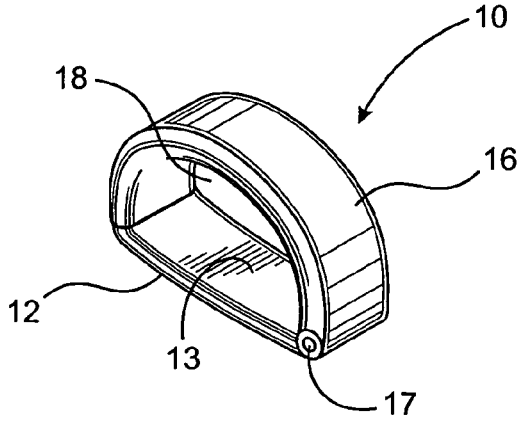
FIG. 13A is a perspective view of the embodiment of FIG. 13.
Figure 13C:
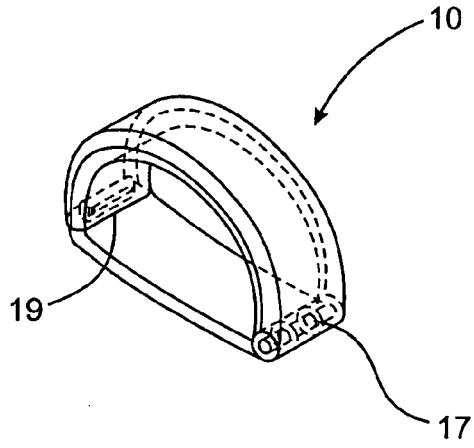
FIG. 13C is the perspective view of the embodiment of FIG. 13 illustrating components of the assembly in phantom lines.
Figure 13B:
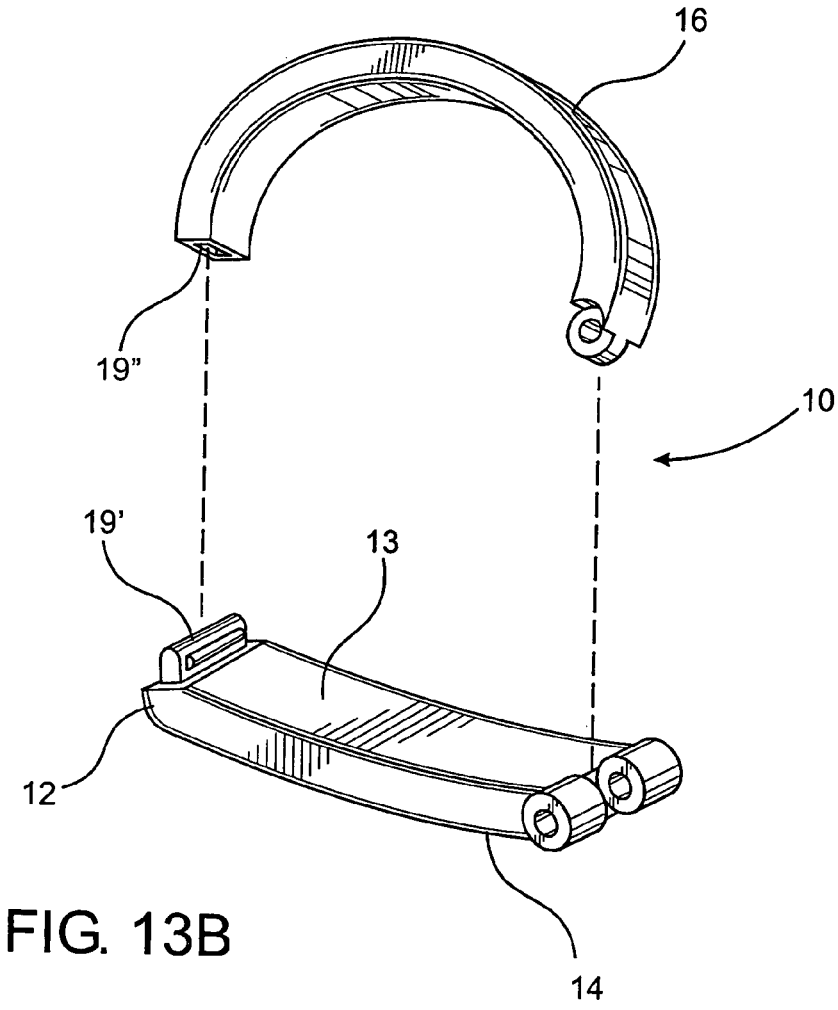
FIG. 13B is a partially exploded perspective view of the embodiment of FIG. 13.

Movable interconnection between the base member 12 and the face member 16 is further illustrated in the embodiment of FIGS. 13 and 14. Specifically, in this preferred embodiment of the necktie assembly 10, the base member 12 is movably interconnected to the face member 16 via a hinge assembly 17. As further illustrated in FIG. 14A, the hinge assembly 17 may comprise a hinge pin 17' structured to permit the base member 12 and the face member 16 to move back and forth in an arcuate path relative to one another about the hinge pin 17' of the hinge assembly 17. Moveable interconnection is also illustrated in the embodiments of FIGS. 15 through 17.

Also as illustrated in FIGS. 13 and 14, this preferred embodiment of the necktie assembly 10 further comprises a tongue and groove type fastener 19 structured to further facilitate the movable interconnection of the base member 12 and the face member 16. The tongue and groove fastener 19 comprises tongue element 19' and groove element 19" structured such that the tongue element 19' is firmly yet removably positionable within the groove element 19", thereby providing a friction fit to further interconnect the base member 12 and the face member 16.

As illustrated in the embodiments of FIGS. 13, 14, and 17, the tongue element 19' is disposed on the base member 12 and the groove element is disposed 19" on the face member 16, however, as illustrated in the embodiment of FIGS. 15 and 16, the tongue element 19' may be disposed on the face member 16 while the groove element 19" is disposed on the base member 12.

Figure 18:
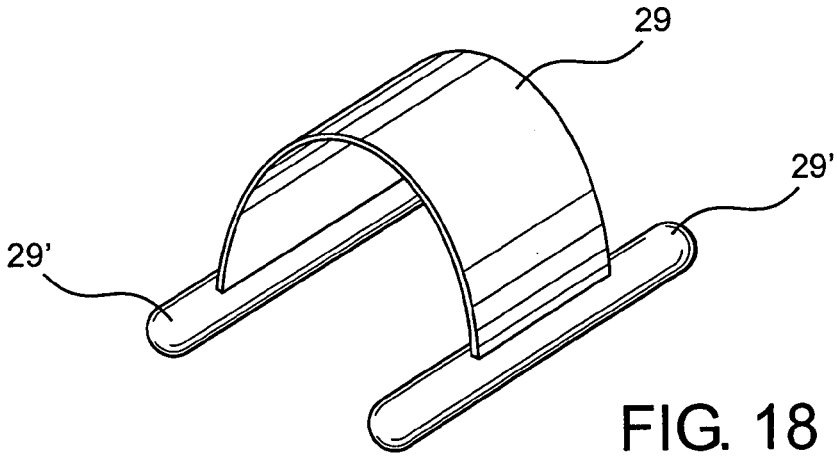
FIG. 18 is a perspective view of one preferred embodiment of a biasing element of the present invention.
Figure 15A:
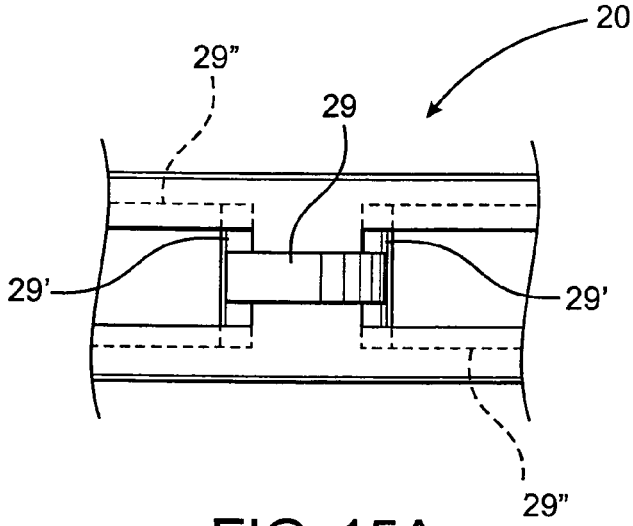
FIG. 15A is a partial front elevation of the base member of the embodiment of FIG. 15 illustrating the biasing element in the uncompressed configuration.
Figure 16A:
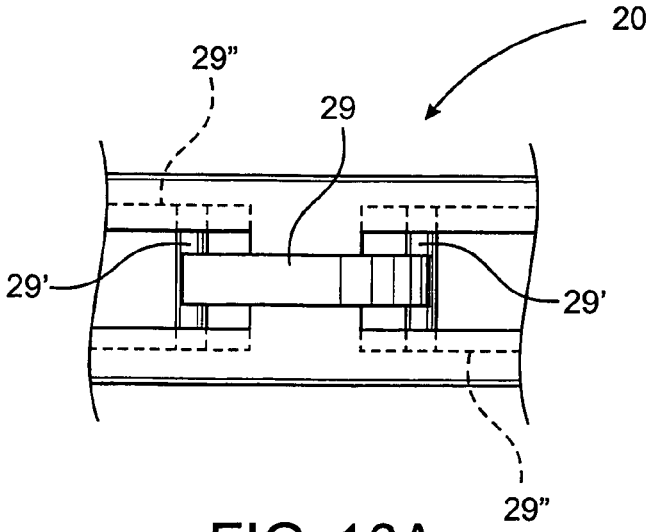
FIG. 16A is a partial front elevation of the base member of the embodiment of FIG. 16 illustrating the biasing element in the compressed configuration.
Figure 17A:
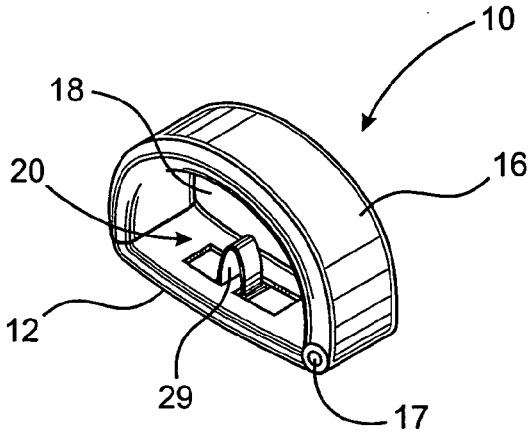
FIG. 17A is a perspective view of the embodiment of FIG. 17.
Figure 17C:
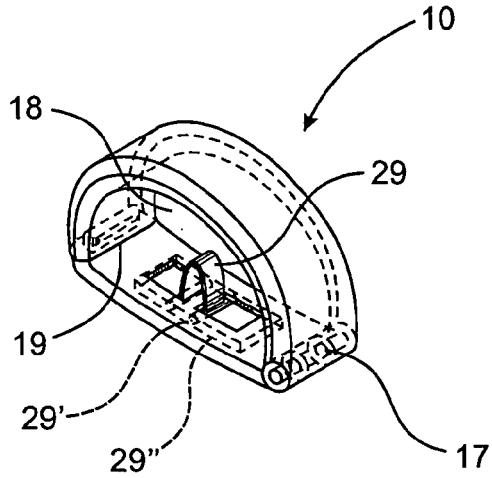
FIG. 17C is the perspective view of the embodiment of FIG. 17 illustrating components of the assembly in phantom lines.
Figure 17B:
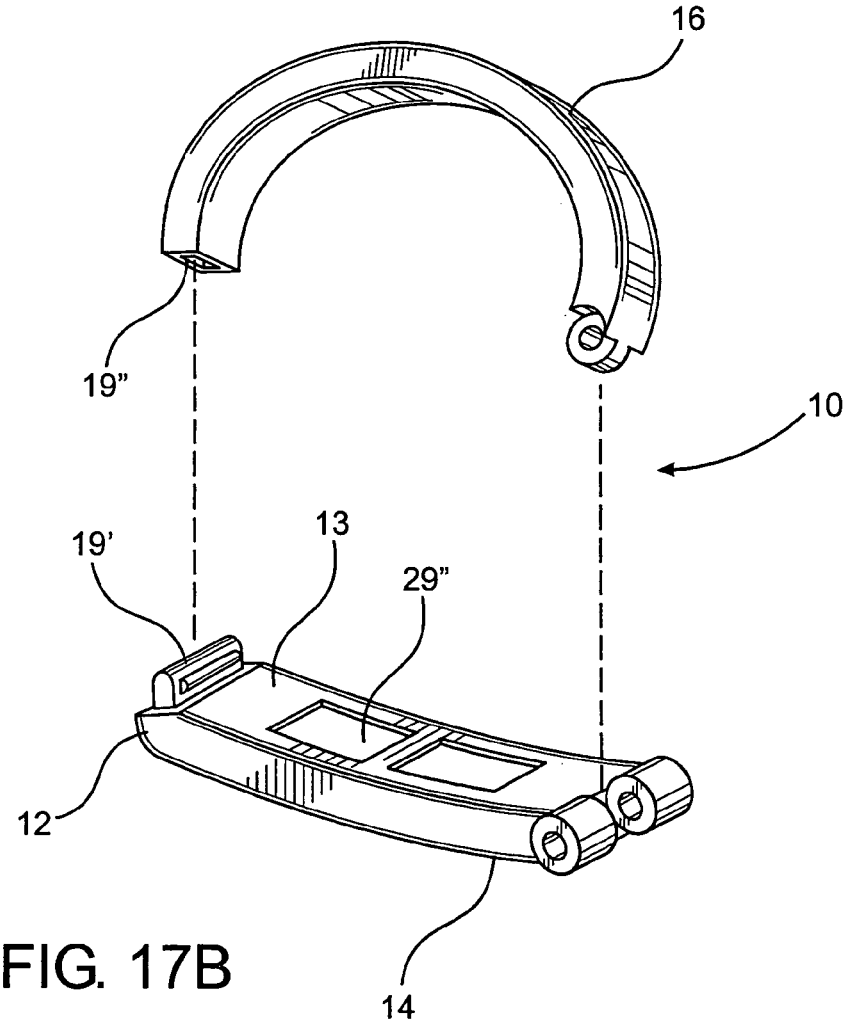
FIG. 17B is a partially exploded perspective view of the embodiment of FIG. 17.

FIGS. 15 through 17 also illustrate a preferred embodiment of the attachment mechanism 20, specifically, an attachment mechanism 20 comprising a biasing element 29. The biasing element 29 may comprise a thin piece of metal or other material exhibiting elastic properties such that the biasing element 29 may be deformed into a compressed configuration under sufficient force, such as illustrated in FIGS. 16 and 16A, but also having a memory so that the biasing element 29 will return to its initial, substantially uncompressed configuration upon removal of the force, as is illustrated in FIGS. 15 and 15A. As illustrated in the embodiment of FIG. 18, the biasing element 29 comprises a pair of guide members 29', however, alternate embodiments of the biasing element 29 may have only one guide member 29', or it may include a plurality of guide members 29'. Each of the guide members 29' are structured to be movably positionable within a different one of each of a plurality of guide tracks 29", as illustrated in the figures, to permit disposition of the biasing element 29 between its compressed configuration and its uncompressed configuration.

In particular, the biasing element 29 of this preferred embodiment is structured such that the force required to position a portion of the necktie through the opening 18 is sufficient to compress the biasing element 29 thereby allowing passage of the portion of the necktie through the opening 18. When the portion of the necktie is in position through the opening 18, the biasing element 29 is structured to return towards its uncompressed configuration with sufficient force to engage the portion of the necktie and force it into contact with the back of the face member 16, thereby securely attaching the necktie assembly 10 to at least a portion of the necktie. Specifically, in one preferred embodiment, the biasing element 29 is structured to engage a portion of an overlying section of the necktie and force it into contact with the back of the face member 16, thereby securely attaching the necktie assembly 10 such that the assembly 10 is not free to slip down and off of the necktie. It will be appreciated that the biasing element 29 can securely attach the necktie assembly 10 to the necktie in such a manner that the necktie will not be damaged, even after repeated usage. In the aforementioned preferred embodiment, the biasing element 29 is structured to engage at least a portion of the overlying section of the necktie, however, it is also understood that the biasing element 29 may engage a portion of an underlying section of the necktie, thereby forcing an adjacent portion of the overlying section of the necktie into contact with the back of the face member 16.

Similar to the embodiment of the necktie assembly 10 comprising a base member 12 having a convex configuration, the biasing element 29 of this preferred embodiment acts to orient the portion of the necktie disposed through the opening 18, such as the overlying section, in an outwardly extending or convex configuration, which, once again, imparts a neat and decorative appearance to the necktie when disposed in an operative position with the necktie assembly 10. Additionally, however, positioning of the necktie assembly 10 of the present invention onto a necktie in an operative position on a wearer, imparts a new and fanciful appearance to the necktie heretofore believed to be unknown in the art.

In one further embodiment, the attachment mechanism 20 may comprise one of the previously described embodiments, structured to securely attach the necktie assembly 10 to at least a portion of the underlying section of the necktie, in combination with the biasing element 29 of the preferred embodiment, structured to engage a portion of the overlying section of the necktie, thereby providing further securement of the necktie assembly 10 to the necktie, such that the necktie assembly 10 is not free to slip down and off of the necktie, once disposed in an operative position.

In addition to the various embodiments of the attachment mechanism 20 specifically disclosed herein, it is understood that numerous other embodiments and/or configurations of the attachment mechanism 20 may be utilized with the present invention, including, but not limited to, a pin, a chain, etc., and it is well within the scope and intent of the present invention to encompass these additional embodiments and/or configurations of the attachment mechanism 20.

Figure 7:
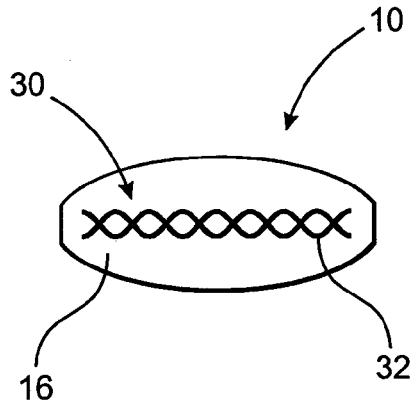
FIG. 7 is a front elevation of the embodiment of FIG. 1 illustrating a decorative motif.
Figure 8:
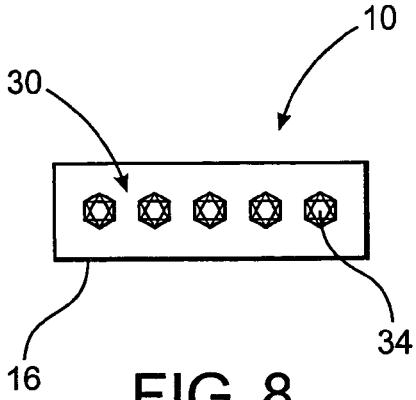
FIG. 8 is a front elevation of the embodiment of FIG. 1-A illustrating gemstones.

With reference now to FIGS. 7 and 8, in at least one embodiment, the necktie assembly 10 of the present invention further comprises an adornment feature, generally shown as 30. In particular, the face member 16 may comprise an adornment feature 30 structured to accentuate the appearance of the wearer of the necktie assembly 10 of the present invention. In one embodiment, the adornment feature 30 may include, by way of example only, a decorative motif 32 such as an emblem, a symbol, the wearer's initials, etc. The decorative motif 32 may be applied onto the face member 16 by any one of a number of well known means such as, by way of example only, painting, etching, engraving, filigree, stamping, etc. It is understood, however, that additional means exist to apply the decorative motif 32, and it is deemed within the scope of the present invention to utilize one or more additional procedures to apply the decorative motif 32 to the face member 16 of the necktie assembly 10 of the present invention.

As shown in FIG. 8, the adornment feature 30 may also comprise one or more gemstones 34 attached to the face member 16. The gemstone(s) 34 may be attached to the face member 16 either alone of in conjunction with the decorative motif 32. It is within the scope of the present invention to utilize either a genuine, synthetic, or simulated gemstone (s) 34 as the adornment feature 30 for the necktie assembly 10 of the present invention. It is further envisioned that the necktie assembly 10 of the present invention may comprise one or more additional adornment features not specifically disclosed herein which are, however, still deemed to be within the scope of the present invention.

It is pointed out that the combination of the position of the inventive necktie assembly 10, when disposed in an operative position adjacent the neck of the wearer, and the resulting look which it offers to the necktie, offers a new and fanciful appearance option to the wearer which, it is believed, has never been known previously. In addition, the combination of the necktie assembly's 10 position with the fact that it can be securely yet removably attached to a necktie allows a person to accessorize his/her wardrobe and accentuate his/her appearance with little to no concern for loss or theft of the necktie assembly 10. Further, the necktie assembly 10 will in several embodiments cause no damage to the necktie itself. As such, the present invention allows the wearer to don an elegant and expensive necktie and also readily allows the necktie assembly 10 to be constructed from a precious metal such as gold, silver, platinum, etc., and/or which may further include one or more gemstones 34 such as diamonds, rubies, emeralds, etc., while maintaining peace of mind that the necktie assembly 10 will not be lost or stolen during use.

Figure 9:
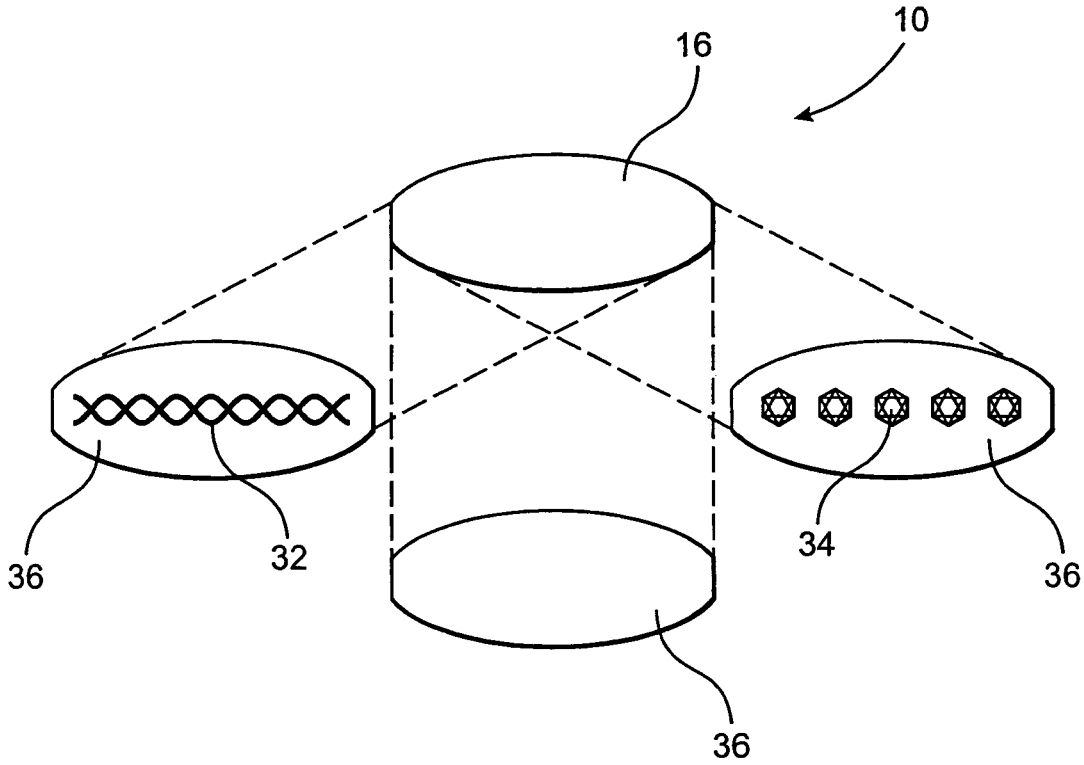
FIG. 9 is an exploded front elevation of the embodiment of FIG. 1 illustrating a plurality of auxiliary face plates.

With reference now to FIG. 9, another embodiment of the necktie assembly 10 is illustrated. In this embodiment, the necktie assembly 10 is structured to allow for some modification of the face member 16 to allow the wearer the option of quickly and easily alternating the external appearance of the necktie assembly 10. For example, and as illustrated in FIG. 9, the necktie assembly 10 of the present invention may comprise a plurality of auxiliary face plates 36, where one auxiliary face plate 36 may comprise a plain finish, while another auxiliary face plate 36 may comprise a decorative motif 32, and yet another auxiliary face plate 36 may comprise one or more gemstones 34. In the illustrated embodiment, the auxiliary face plate 36 of the present invention is structured to be securely yet removably attached to the face member 16 by any one of a number of removable attachment devices.

Figure 11:
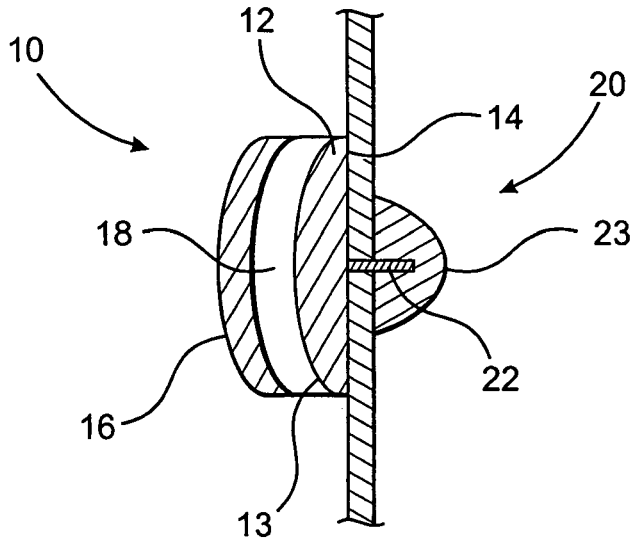
FIG. 11 is a partial cross sectional view of the embodiment of the necktie assembly of FIG. 10 along lines 11—11 thereof, illustrating one embodiment of secure yet removable attachment of the necktie assembly to the underlying section of the necktie.
Figure 10:
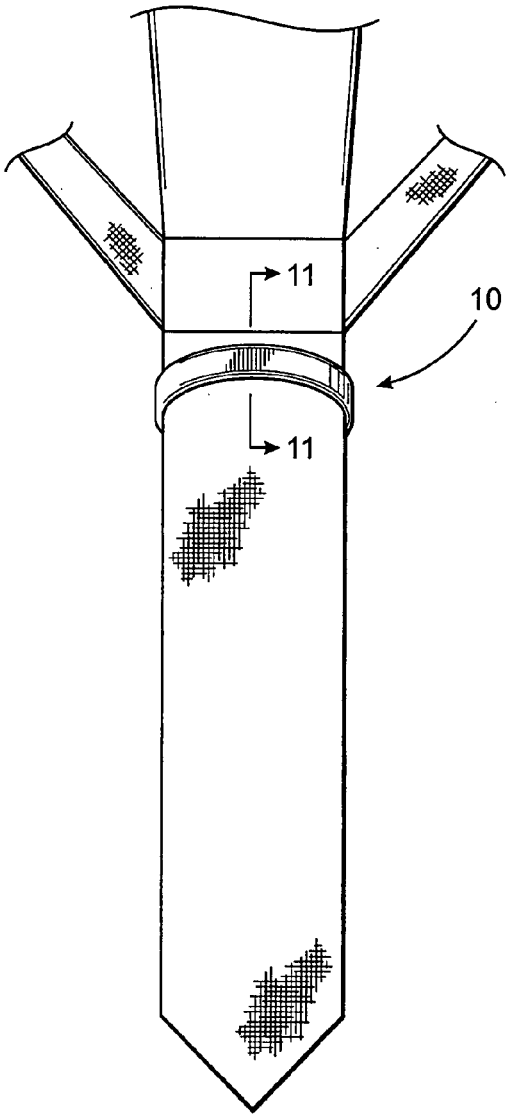
FIG. 10 is a perspective view of one embodiment of the necktie assembly of the present invention in secure yet removable attachment to an underlying section of a necktie.

With reference now to FIG. 10, the present invention is also understood to comprise a method to facilitate donning a necktie generally, as well as in a neat and decorative, new and fanciful, yet operative position on a wearer with the inventive necktie assembly 10. In particular, in at least one embodiment, the method includes forming at least a partial knot in the necktie which is disposed in an at least partially surrounding relation to the wearer's neck, and tightening the partial knot into an operative position adjacent the wearer's neck, as illustrated in FIG. 10. The method of the present invention further comprises attaching a necktie assembly 10 to a portion of the necktie, for example, a portion of an underlying section of the necktie, below and adjacent the partial knot, and preferably, removably yet securely attaching the necktie assembly 10 to the portion of the necktie. FIG. 11 illustrates a partial cross sectional view of the necktie assembly 10, as in FIG. 4, removably yet securely attached to an underlying section of the necktie.

Figure 12:
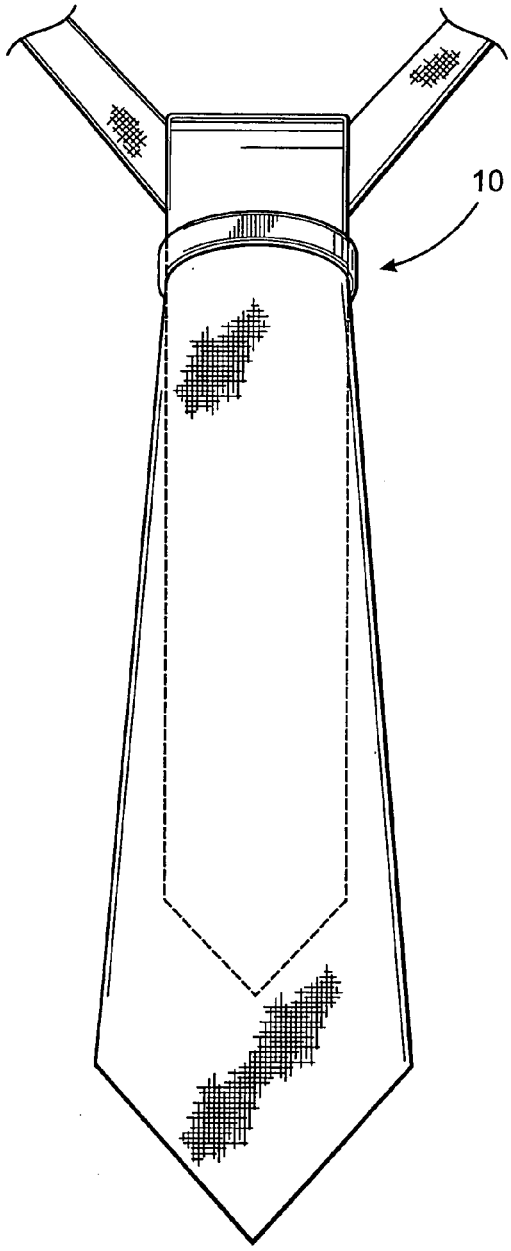
FIG. 12 is a perspective view of the necktie assembly of FIG. 10 in an operative position relative to a necktie.

In addition, the method comprises positioning an overlying section of the necktie into an overlying disposition relative to the partial knot, and looping a free end of the overlying section of the necktie through an opening or slot 18 in the necktie assembly 10. Further, the method provides for tightening the overlying section of the necktie into a neat and operative position through the opening 18 in the necktie assembly 10, as illustrated in FIG. 12.

Accordingly, a new, useful and unobvious necktie assembly 10 and method for utilizing the same has been described herein which allows one to wear a necktie in an operative position having a neat and decorative, new and fanciful appearance, but which does not require more than an average level of skill to partially form a knot in the necktie, as the method eliminates the need to fully tie a decorative knot in the necktie. In addition, the present invention is structured such that it may be utilized with any number of neckties. Further, at least one embodiment has been described which allows the external appearance to be quickly and easily varied so as to meet the design preferences of various users, and also, to permit the necktie assembly 10 to accentuate neckties having a wide variety of styles, colors, and/or patterns with a new and fanciful appearance.

Since many modifications, variations and changes in detail can be made to the described preferred embodiment of the invention, it is intended that all matters in the foregoing description and shown in the accompanying drawings be interpreted as illustrative and not in a limiting sense. For example, while it is contemplated that the assembly and method of the present invention eliminate the need to fully tie a decorative knot in the necktie, some variations in the way individuals will actually use or follow the invention are expected, and as such, fully tied knots and other types of knots made to the necktie should be deemed to fall within the spirit and scope of the invention. Thus, the scope of the invention should be determined by the appended claims and their legal equivalents.

Now that the invention has been described,

What is claimed is:

1. A necktie assembly, said assembly comprising:

a base member, a face member disposed in an at least partially overlying and an interconnecting relation to said base member and at least partially defining an opening between said face member and said base member, said opening is further defined by at least one intersection between said base member and said face member, an attachment mechanism at least partially interconnected to said base member, said attachment mechanism structured to engage at least a portion of a necktie passing through said opening, and said attachment mechanism is movably interconnected to an outer surface of said base member.

2. A necktie assembly, said assembly comprising:

a base member, a face member movably interconnected to said base member, said face member disposed in an at least partially overlying relation to said base member, said overlying relation at least partially defining an opening between said base member and said face member, an attachment mechanism disposed in an operable orientation along a portion of said base member, said attachment mechanism structured to securely engage at least one portion of a necktie, said attachment mechanism comprising a biasing element structured to securely attach said necktie assembly to said at least one portion of the necktie, said portion of said base member comprising an outer surface, and said biasing element further comprising a plurality of guide members to facilitate disposition of said biasing element into said operative orientation along said outer surface.

3. An assembly as recited in claim 2 wherein said base member comprises a plurality of guide tracks disposed along said outer surface, each of guide tracks structured to receive a different one of said plurality of guide members.

4. An assembly as recited in claim 3 wherein each of said guide members are movably positionable within a different one of said guide tracks to permit disposition of said biasing element between an uncompressed configuration and a compressed configuration.

* * * * *